US007003014B2

(12) United States Patent
Uemori et al.

(10) Patent No.: US 7,003,014 B2
(45) Date of Patent: Feb. 21, 2006

(54) ELECTRIC HEATER FOR THERMAL TREATMENT FURNACE

(75) Inventors: Susumu Uemori, Tenri (JP); Takashi Aitani, Tenri (JP)

(73) Assignee: Koyo Thermo Systems Co., LTD, Tenri (JP)

( * ) Notice: Subject to any disclaimer, the term of this patent is extended or adjusted under 35 U.S.C. 154(b) by 0 days.

(21) Appl. No.: 10/498,503

(22) PCT Filed: Mar. 19, 2002

(86) PCT No.: PCT/JP02/02572

§ 371 (c)(1),
(2), (4) Date: Jun. 18, 2004

(87) PCT Pub. No.: WO03/078910

PCT Pub. Date: Sep. 25, 2003

(65) Prior Publication Data

US 2005/0069014 A1 Mar. 31, 2005

(51) Int. Cl.
*H05B 3/62* (2006.01)

(52) U.S. Cl. ..... 373/117; 373/127

(58) Field of Classification Search ..... 373/109, 373/117–119, 127–137; 219/388, 390, 405, 219/411

See application file for complete search history.

(56) References Cited

U.S. PATENT DOCUMENTS

| | | | | |
|---|---|---|---|---|
| 4,346,252 A | * | 8/1982 | Walton et al. | 373/137 |
| 4,493,089 A | * | 1/1985 | Abell | 373/130 |
| 5,038,019 A | * | 8/1991 | McEntire et al. | 219/390 |
| 5,229,576 A | * | 7/1993 | Nakao et al. | 219/390 |
| 5,323,484 A | * | 6/1994 | Nakao et al. | 373/137 |
| 5,507,639 A | | 4/1996 | Monoe | |

FOREIGN PATENT DOCUMENTS

| | | |
|---|---|---|
| JP | 59-177890 A | 10/1984 |
| JP | 10-50464 A | 2/1998 |
| JP | 2001-267261 A | 9/2001 |

* cited by examiner

*Primary Examiner*—Tu Hoang
(74) *Attorney, Agent, or Firm*—Armstrong, Kratz, Quintos, Hanson & Brooks, LLP.

(57) ABSTRACT

A heating element (12) made of metal wire is installed at an internal circumferential surface of a cylindrical main thermal insulation body (11) of an electric heater according to the present invention. The heating element (12) comprises a plurality of resistance heat emitting portions (61)–(64) (71)–(74) (81)–(84) as segments along its length direction. The resistance heat emitting portions (61)–(64) (71)–(74) (81)–(84) are connected in parallel.

5 Claims, 6 Drawing Sheets

ELECTRIC HEATER FOR THERMAL TREATMENT FURNACE

BACKGROUND ART

The present invention relates to an electric heater for heat treating furnaces, and, particularly, it is suitably used for heat treating equipments to perform, for example, heat treatments such as oxidation, diffusion, and/or CVD of semiconductor wafers.

Conventionally, an electric heater is known which uses a heating element installed at an internal circumferential surface of its cylindrically shaped main thermal insulation body, the heating element being formed to coil shape out of a metal wire referred to as "heavy gauge" whose diameter is 7 to 10 mm.

Then, as a replacement to the above-mentioned electric heater, the present applicant proposed previously an electric heater which is disclosed by a Japanese Patent Application Publication Number 2001-267261. This utilizes a metal wire referred to as "light gauge" of which diameter is 1 to 3 mm, and a plurality of parallel grooves are formed at an internal circumferential surface of its main thermal insulation body extending along its length direction at an interval in its circumferential direction. And a heating element which is made out of a continuous matal wire and formed to sinuous shape with an amplitude bigger than width of the groove is supported unitedly by the main thermal insulation body with both end portions of its amplitude plunging beyond the sidewalls of each corresponding groove into the main thermal insulation body, and meanders in the circumferential direction of the main thermal insulation body so as to extend over all grooves from one to next.

Because a heavy gauge metal wire is used in the aforementioned conventional electric heater, weight of the heating element is heavy, then, it has a large heat capacity. A problem with such a heater is that a fast heat-up or cool-down cannot be achieved. Besides, energy loss per heat cycle is large.

In this regard, the above-mentioned electric heater of the applicant has solved these problems by utilizing a light gauge metal wire.

However, since there is a difference in current specification between the former and the latter types of heater, the latter type heater cannot be employed directly to an existing heat treating equipment where the former type heaters have been installed. This is because wire diameter is different between both types, then, in order that both types of electric heater have an equal output, the latter has to be driven under a high voltage and small current condition, while the former under a low voltage and large current condition. For example, a step-down transformer is required for a low voltage and large current drive, while transformer-less usage is presupposed for a high voltage and small current drive.

Difference in power supply specifications between two types of conventional heater was mentioned above. Then, to enable an utilization of a light gauge electric heater with improved thermal characteristics to replace an existing heat treating equipment where a heavy gauge heater has been used, compatibility in physical or constitutional aspect is also required in addition to its adaptation to power supply specifications. In other words, compatibility related to such as outside diameter, inside diameter, and length of the heater is required, and further, compatibility related to such as division of temperature zones and its power allotment is required to achieve a temperature profile.

Purpose of the present invention is to provide an electric heater which can heat-up and cool-down at a high rate, and moreover, can be driven at a low voltage and large current.

DISCLOSURE OF THE INVENTION

An electric heater for a heat treating furnace according to the present invention is characterized by an electric heater for a heat treating furnace comprising: a heating element which is made using a metal wire and installed at an inside surface of a main thermal insulation body; an inner thermal insulating material layer and an outer thermal insulating material layer jacketing outside the main thermal insulation body; and the heating element comprising a plurality of resistance heat emitting portions which are disposed in parallel in the circumferential direction of the main thermal insulation body, wherein: a pair of connecting members which are flat in thickness direction of the main thermal insulating body and extend along the circumferential direction of the main thermal insulating body are positioned between the inner thermal insulating material layer and the outer thermal insulating material layer respectively at a distance corresponding to the span of the heat emitting portion; and ends of the resistance heat emitting portion pierce through the main thermal insulation body and the inner thermal insulating material, and are connected to a connecting member of corresponding side, respectively.

With the electric heater for a heat treating furnace according to the present invention of which main thermal insulation body is installed at its inside surface a heating element which is made using a metal wire, since the heating element comprises a plurality of resistance heat emitting portions connected in parallel, the resistance value of the heating element is lower than that of a heating element made of a continuous metal wire. Although the heating element uses a light gauge metal wire, it can be driven under low voltage and large current condition which is equivalent to that of the heating element using a continuous heavy gauge metal wire. In addition, weight of the wire can be reduced to as small as about 1/10 of that with a heavy gauge wire. Thus, heat capacity of the wire is reduced to about 1/10. This allows one to provide a heater which can heat-up and cool-down at a high rate, and moreover, can be driven at a low voltage and large current.

Besides, because a pair of connecting members are made to interpose between the plural resistance heat emitting portions, the resistance heat emitting portions need not be connected directly among each other.

Further, in case where an inner thermal insulating material layer and an outer thermal insulating material layer jacket outside the main thermal insulation body, and where both connecting members are positioned between the inner thermal insulating material layer and the outer thermal insulating material layer, then, the connecting members can be isolated from high-temperature section of the heater, therefore, unfavorable influence of the parts of the parallel connections on temperature profile can be avoided, and their thermal distortion hardly occurs as well, which secures a construction with high thermal stability.

Furthermore, in the event where a sleeve or a cap is fitted on each end of respective resistance heat emitting portion and fixed by calking and/or welding, a number of open holes corresponding to the number of resistance heat emitting portions are opened in each connecting member, and where a sleeve or a cap is put through an open hole at a corresponding end, the sleeve or the cap and fringe of the open hole are welded, and where the resistance heat emitting portions, connecting members, and sleeves or caps are formed out of a same kind of material, then, the discontinuity of physical property, particularly discontinuities of metallurgy and thermal expansion coefficient can be avoided between the resistance heat emitting portion, the connecting member, and the sleeve or the cap, thus, even higher thermal stability can be achieved.

Additionally, in case where a number of parallel grooves not less than the number of the resistance heat emitting portions are formed at the inside surface of the main thermal insulation body, each resistance heat emitting portion is formed to a sinuous shape with an amplitude bigger than width of the groove, supported unitedly by the main thermal insulation body with both end portions of the amplitude plunging beyond the sidewalls of each corresponding groove into the main thermal insulation body, and extending from one groove over to next one at least, then, a construction is achievable which enables easy use of a light gauge metal wire for a heating element.

Moreover, when the inner insulating material and the outer insulating material each comprise a pouch made of heat-resistant cloth which encloses a great many hollow microspheres of microporous thermal insulating material, both the inner and the outer thermal insulating materials exhibit extremely high thermal insulating characteristic due to the function of the hollow microspheres.

BEST MODE FOR CARRYING OUT THE INVENTION

An embodiment of the present invention is explained in the following making reference to the drawings.

Figure 1:
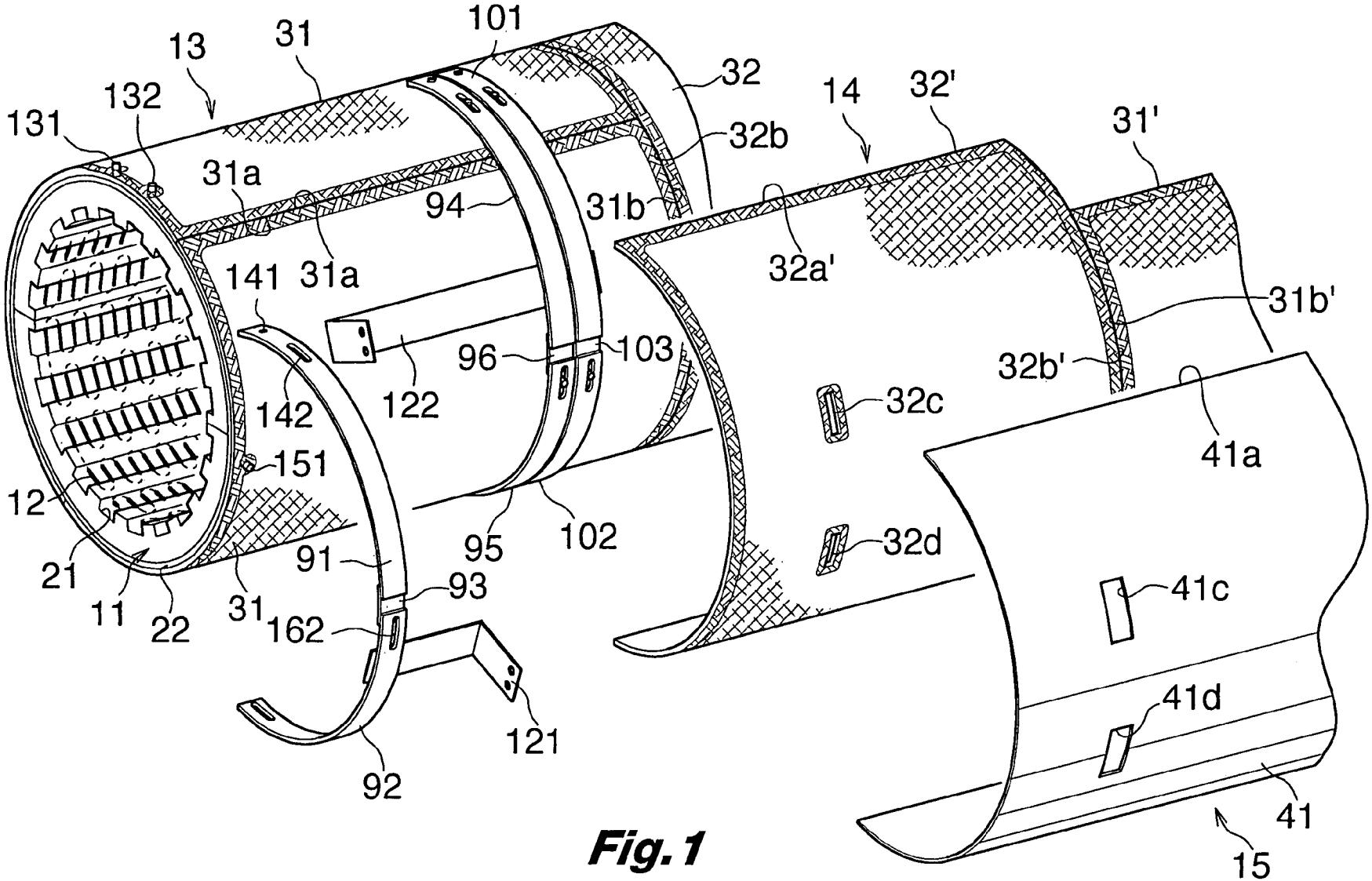
FIG. 1 is an exploded perspective view of an electric heater according to the present invention.
Figure 2:
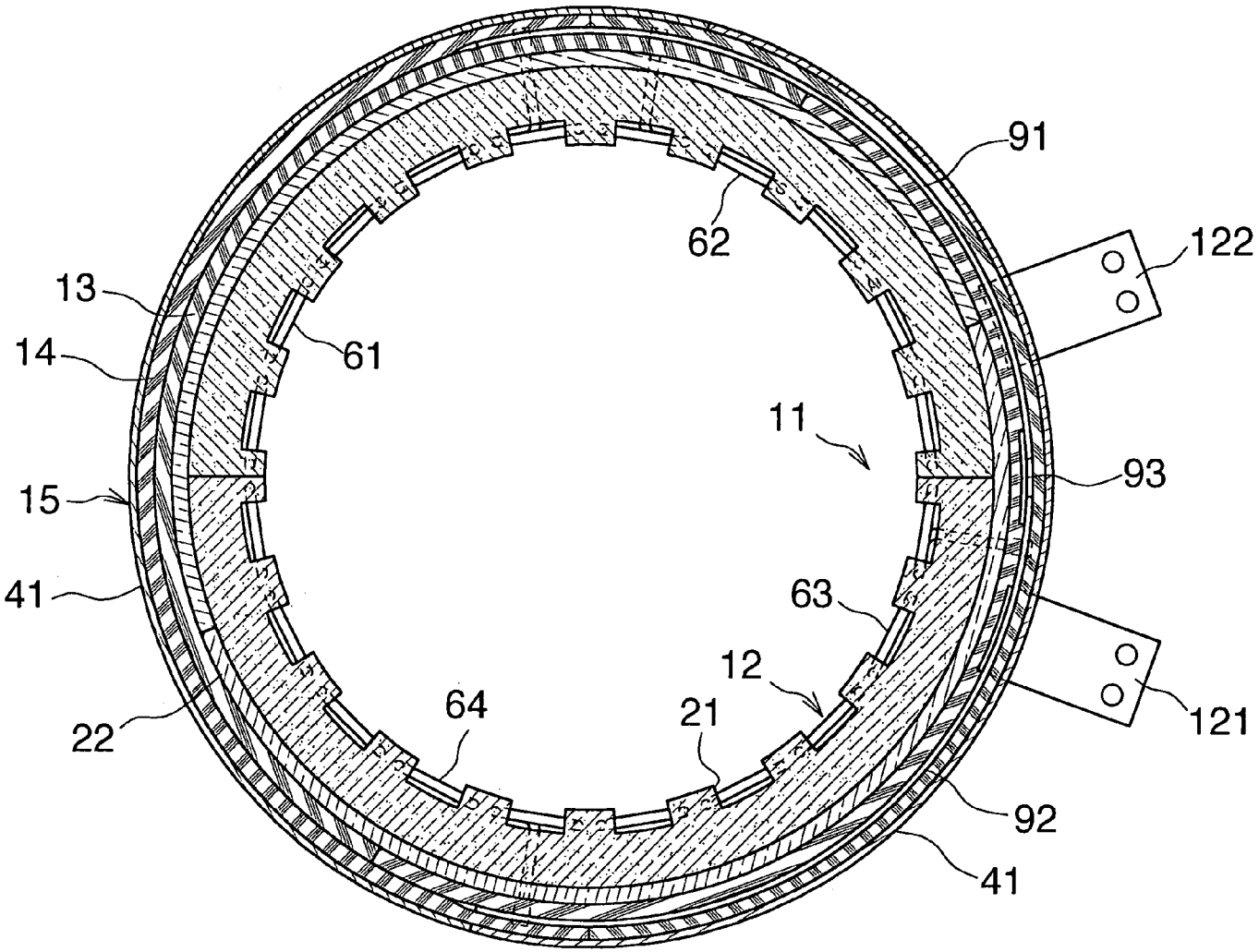
FIG. 2 is a transverse cross-sectional view of the electric heater.

Referring to FIGS. 1 and 2, an electric heater comprises a cylindrical main thermal insulation body (11), a heating element (12) installed at an internal circumferential surface of the main thermal insulation body (11), layers of inner thermal insulating material (13) and outer thermal insulating material (14) jacketing thereof intervened by a flexible mat as a buffer (22) consisting of ceramic fiber covering the external circumferential surface of the main thermal insulation body (11), and a metal shell (15) mantling the contour of the outer thermal insulating material layer (14).

Figure 4:
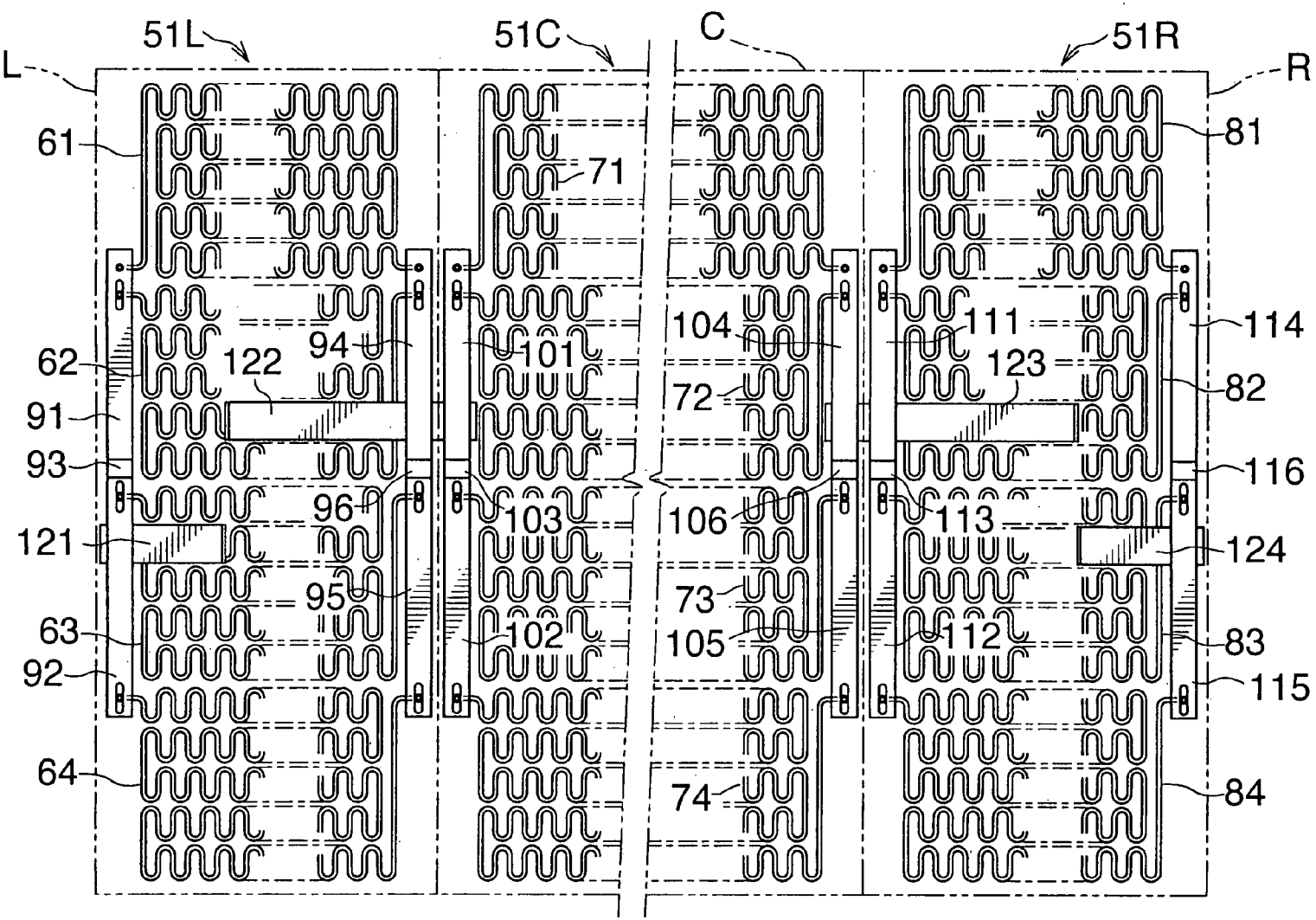
FIG. 4 is a development view of a heating element of the electric heater.

With reference to FIG. 4, the electric heater is, from left to right successively, allotted for left zone (L), center zone (C) and right zone (R). In FIG. 1, only the left zone (L) and part of the center zone (C) are shown.

The main thermal insulation body (11) is vacuum formed ceramic fiber, which is heat insulating material. At the internal circumferential surface of the main thermal insulation body (11) a plurality of parallel grooves are formed extending along the length direction of the main thermal insulation body (11) at an interval in its circumferential direction. Concretely, the number of grooves (21) in this embodiment is twenty.

The heating element (12) consists of iron-chromium-aluminum alloy, and uses a light gauge metal wire of which diameter is 1–3 mm, as explained in the beginning.

Figure 3:
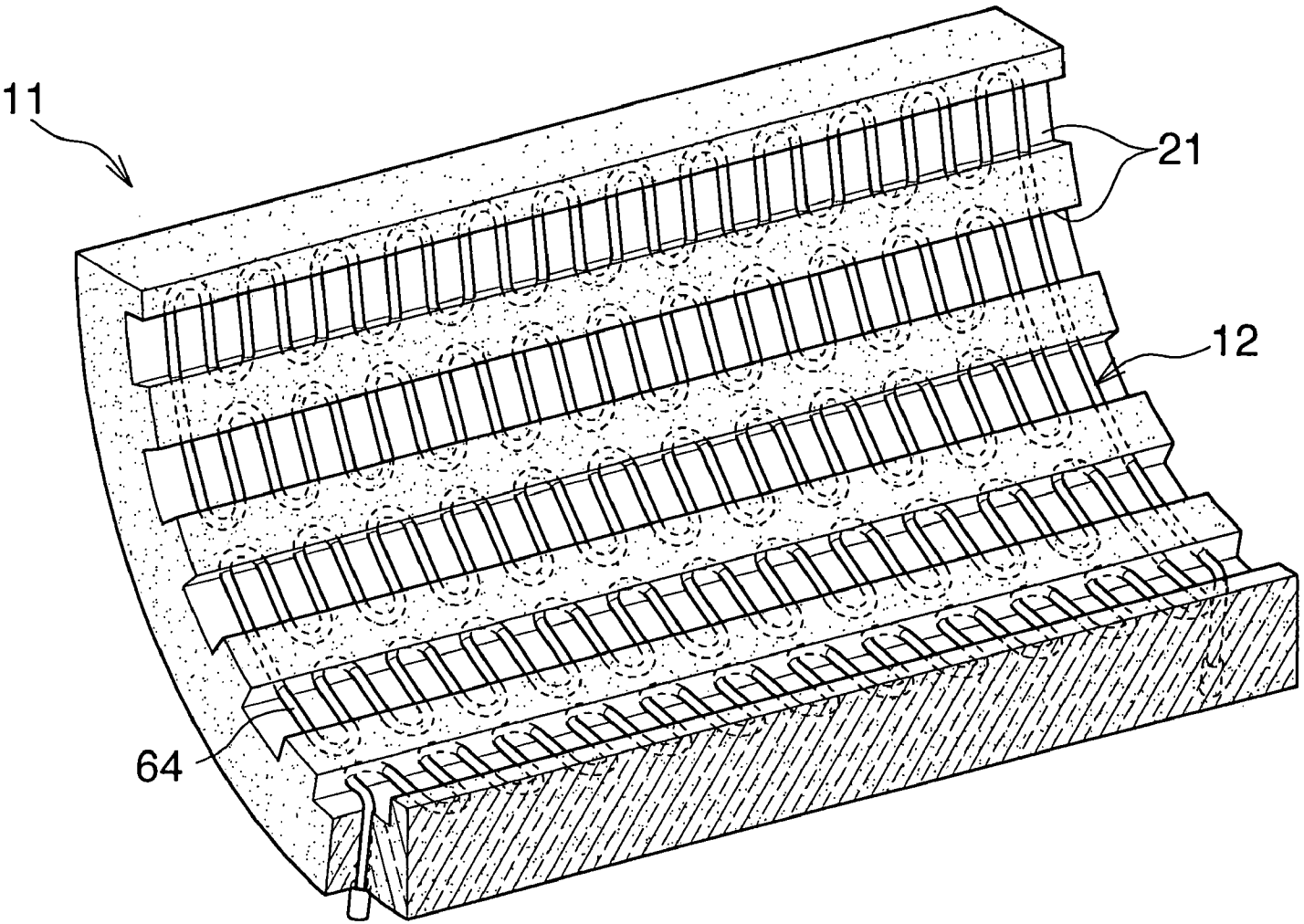
FIG. 3 is a fragmentary perspective view of the main thermal insulation body and a heating element of the electric heater.

Part of how a heating element (12) is installed is shown in FIG. 3. The heating element (12) is formed to sinuous shape. Amplitude of the sinuous shape heating element (12) is made bigger than width of the groove (21). The heating element (12) formed to sinuous shape is supported unitedly by the main thermal insulation body (11) with both end portions of its amplitude plunging beyond the sidewalls of the grooves into the main thermal insulation body.

In FIG. 3, at the left end of first groove (21) from this side, one end of the heating element (12) pierces through bottom of the groove (21) and is made to protrude out of the main thermal insulation body (11). From this end, the heating element (12) meanders, extends to the right in the groove (21), and reaches the right end of the groove (21). At the right end of the groove (21), the heating element (12) pierces through the ridge (wall) in between and gets into the adjoining groove (21) which is second from this side. From there, then, toward the opposite direction, it extends to the left in the second groove (21). From the left end of the second groove (21), it gets into the third groove (21), and extends therein to the right, the same direction as in the first groove (21) of this side. In this way, the heating element (12), meandering in the circumferential direction of the main thermal insulation body (11), moves between grooves (21) next to each other sequentially from the first groove (21) of this side to the fifth groove (21) from this side. The heating element (12), after extending in the fifth groove (21) and reaching its right end, pierces through all the walls (ridges) between adjacent grooves (21) there from, and returns back to the right end of the first groove (21) of this side. From the right end of the first groove (21) of this side, the other end of the heating element pierces through bottom of the groove (21), and is made to protrude out of the main thermal insulation body (11).

The above is an example, and configuration of the heating element (12) may be modified appropriately for optimum design. For example, instead of piercing through walls (ridges) between adjacent grooves (21), a heating element (12) may be configured so as to lay over them.

The inner thermal insulating material (13) includes two types, long pouch (31) and short pouch (32), each formed in half cylinder shape. Each pair of the long or short half cylinder pouches (31) (32) of the same type abut at their hems **(31*a*) (32*a*) surrounding the main thermal insulation body (11) to make a complete long or short cylindrical pouch (31) (32), respectively. The long and short pouches (31) (32) are arranged alternately in this order along the length of the main thermal insulation body (11) from its left edge, and thus, the whole external surface of the main thermal insulation body (11) is surrounded by the long and short pouches (31) (32). Additionally, respective abutting position at hems (31*a*) (32*a*) of adjacent long and short half cylinder pouches (31) (32) is shifted between each other along the circumferential direction of the main thermal insulation body (11)**.

The long and short pouches (31) (32) respectively encloses hollow microspheres of microporous thermal insulating material in a heat-resistant cladding-material made of silica or glass fabrics, and is compressed, for example, to form half cylinder shape. It is hardly flexible, and not easy to deform. Each hollow microsphere is of micron-order size containing silica as main constituent, and accumulates to include a large number of micropores. Silica fabrics as cladding-material are resistant to temperatures higher than 600 degrees Celsius. Inside diameter of a hollow microsphere is made to be less than mean free path of the atmospheric gas molecules. Therefore, it is understood that the atmospheric gas molecules are isolated by walls of hollow microspheres, and that the probability of a gas molecule being bounced by the wall becomes so high that collision between gas molecules is suppressed. Consequently, both the long and short pouches (31) (32) show a superior thermal insulating characteristic.

Although the outer thermal insulating material (14) differs from the inner thermal insulating material (13) in diameter etc., it consists of both long and short pouches (31') (32') in the same manner as the latter. These long and short pouches (31') (32') are arranged in the same way as the long and short pouches (31) (32) of the inner thermal insulating material (13), yet surrounding the entire outside surface of the inner thermal insulating material (13). However, arranging order of long and short pouches (31) (32) (31') (32') along the length of the main thermal insulation body (11) is opposite between the inner thermal insulating material (13) and the outer thermal insulating material (14), and thus, the positions where the facing edges **(31*b*) (32*b*) (31*b*') (32*b*') of the neighboring cylindrical long and short pouches (31) (32) (31') (32') meet are shifted along the length of the main thermal insulation body (11). Additionally, two slits (32*c*) (32*d*) are opened in the short pouch (32') of the left end of the outer thermal insulating material (14)**.

The shell (15) is made of a plurality of stainless steel sheets (41) formed in half cylinder shape. The two shell sheets (41) abut their hems **(41*a*) each other in similar way as two pouches (31) (32) (31') (32'), and cover the outer thermal insulating material (14). In one of the shell sheet (41) of the left end are opened slits (41*c*) (41*d*) corresponding to slits (32*c*) (32*d*) of the short pouch (32')**.

Again, referring to FIG. 4, overall configuration of a heating element (12) is explained in detail. In FIG. 4, the main thermal insulation body (11) is developed in its circumferential direction, and the heating element (12) as viewed from outside direction of the main thermal insulation body (11) is represented.

The heating element (12) comprises a group of resistance heat emitting portions for left zone (51L), a group of resistance heat emitting portions for center zone (51C), and a group of resistance heat emitting portions for right zone (51R). These groups of elements (51L) (51C) (51R) are configured such that they are controllable independently each other as described below.

The group of resistance heat emitting portions for left zone (51L) comprises four resistance heat emitting portions #1 through #4 (61)–(64), which are like splitting a heating element (12) along its length. The #1 through #4 resistance heat emitting portions (61)–(64) usually employ portions having a same electric resistance value, are disposed in this order from top to bottom in FIG. 4, and connected electrically in parallel. The fourth resistance heat emitting portion (64) corresponds to the heating element (12) that was explained referring to FIG. 3. The first through third resistance heat emitting portions (61)–(63) are supported by the main thermal insulation body (11) in the same manner as the fourth resistance heat emitting portion (64). The number of grooves (21) of the main thermal insulation body (11) is twenty as noted earlier, and each 5 grooves (21) correspond to each of #1 through #4 resistance heat emitting portions (61)–(64).

In the same way as the group of resistance heat emitting portions for left zone (51L), the group of resistance heat emitting portions for center zone (51C) comprises #1 through #4 resistance heat emitting portions (71)–(74), and the group of resistance heat emitting portions for right zone (51R) includes #1 through #4 resistance heat emitting portions (81)–(84). These resistance heat emitting portions (71)–(74) (81)–(84) are also supported by the main thermal insulation body (11) in the same manner as the fourth resistance heat emitting portion (64) of the group of resistance heat emitting portions for left zone (51L).

At the left side of the group of the resistance heat emitting portions for left zone (51L) are disposed two, i.e. upper and lower, first connecting members (91) (92) in strip form so as to extend along top to bottom direction. The first upper and lower connecting members (91) (92) are connected by first joint bar (93). Similarly, at the right side of the group of the resistance heat emitting portions for left zone (51L) are disposed two, i.e. upper and lower, second connecting members (94) (95) in strip form. The second upper and lower connecting members (94) (95) are connected by second joint bar (96).

In the same way as the group of resistance heat emitting portions for left zone (51L), the group of resistance heat emitting portions for center zone (51C) comprises connecting members (101) (102) (104) (105) and joint bars (103) (106), and the group of resistance heat emitting portions for right zone (51R) includes connecting members (111) (112) (114) (115) and joint bars (113) (116).

The left ends of the first and second resistance heat emitting portions (61) (62) of the group of resistance heat emitting portions for left zone (51L) are connected to the first upper connecting member (91), and their right ends are connected to the second upper connecting member (94). The left ends of the third and fourth resistance heat emitting portions (63) (64) of the same group of resistance heat emitting portions (51L) are connected to the first lower connecting member (92), and their right ends are connected to the second lower connecting member (95). Parallel connections of the group of resistance heat emitting portions for left zone (51L) are realized by the above method. The embodiment of the connection is similarly applicable to the groups of resistance heat emitting portions for center zone (51C) and right zone (51R) as well.

To the first lower connecting member (92) to the group of resistance heat emitting portions for left zone (51L) is connected first terminal (121) of L-shaped strip. To the second upper connecting member (94) to the group of resistance heat emitting portions for left zone (51L), and to the first upper connecting member (101) to the group of resistance heat emitting portions for center zone (51C) is connected left middle terminal (122) made of L-shaped strip, extending over both connecting members (94) (101). Further, to the second upper connecting member (104) to the group of resistance heat emitting portions for center zone (51C), and to the second upper connecting member (111) to the group of resistance heat emitting portions for right zone (51R) is connected right middle terminal (123) made of L-shaped strip, extending over both connecting members (104) (111). To the first lower connecting member (115) to the group of resistance heat emitting portions for right zone (51R) is connected second terminal (124) made of L-shaped strip. Thus, the heating element (12) is connected such that the group of resistance heat emitting portions for left zone (51L), the group of resistance heat emitting portions for center zone (51C), and the group of resistance heat emitting portions for right zone (51R) are electrically controllable independently.

Figure 5:
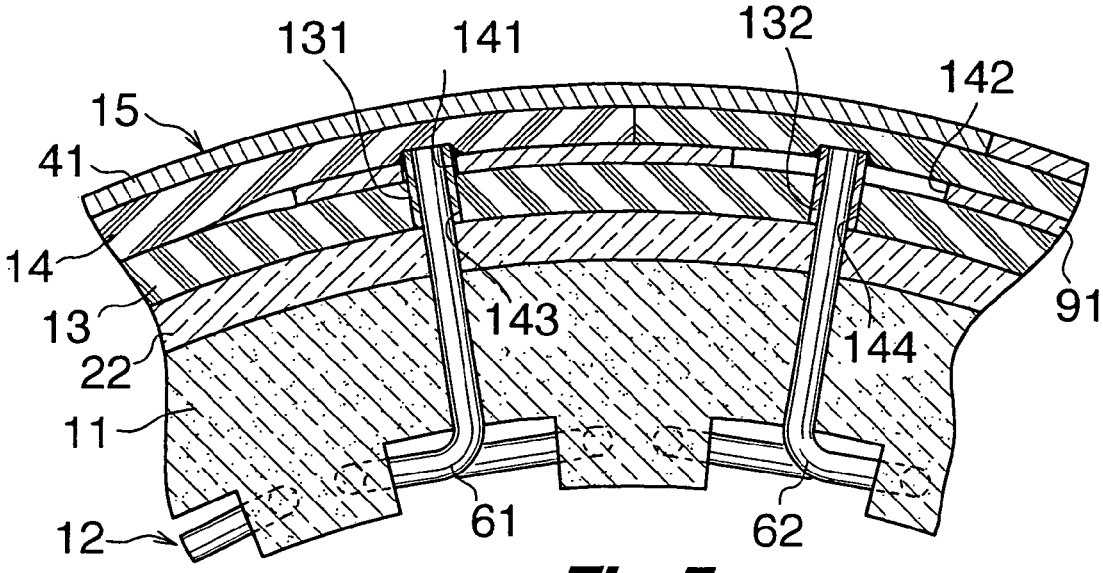
FIG. 5 is an enlarged transverse cross-sectional view which shows a connection condition at one end of the heating element.

FIG. 5 shows where connections are made between left ends of the first and second resistance heat emitting portions (61) (62) of the group of resistance heat emitting portions for left zone (51L) and the first upper connecting member (91). Over a respective end of the first and second resistance heat emitting portions (61) (62) is fitted first and second cylindrical sleeves (131) (132), respectively. Each sleeve (131) (132), caulked and then welded, is fixed to the corresponding end of the resistance heat emitting portions (61) (62). The connecting member (91) has a round hall (141) and an oval hole (142). In agreement with the round hall (141) and the oval hole (142), two round holes (143) (144) are opened in the inner thermal insulating material (13). The first sleeve (131) pierces through the two round holes (141) (143). The external surface of the sleeve (131) is welded to the fringes of the round holes (141) (143). The second sleeve (132) pierces through the oval hole (142) and the round hole (144). The external surface of the sleeve (132) is welded to the fringes of the oval hole (142) and the round hole (144).

Figure 7:
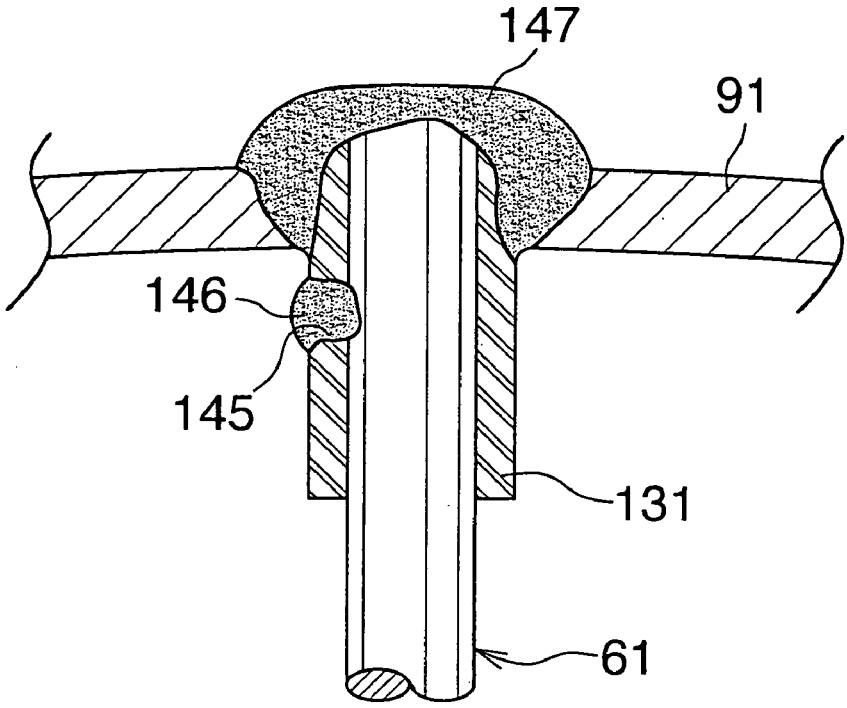
FIG. 7 is an enlarged cross-sectional view of a part shown in FIG. 5.

An embodiment of the above-mentioned welding of the first sleeve (131) is shown in detail in FIG. 7. A welding aperture (145) is opened through the circumferential wall of the first sleeve (131). A weldment (146) is formed so that the welding aperture (145) is full. Further, another weldment (147) is formed which jackets the end of the first resistance heat emitting portion (61), the first sleeve (131) and its perimeter.

Figure 6:
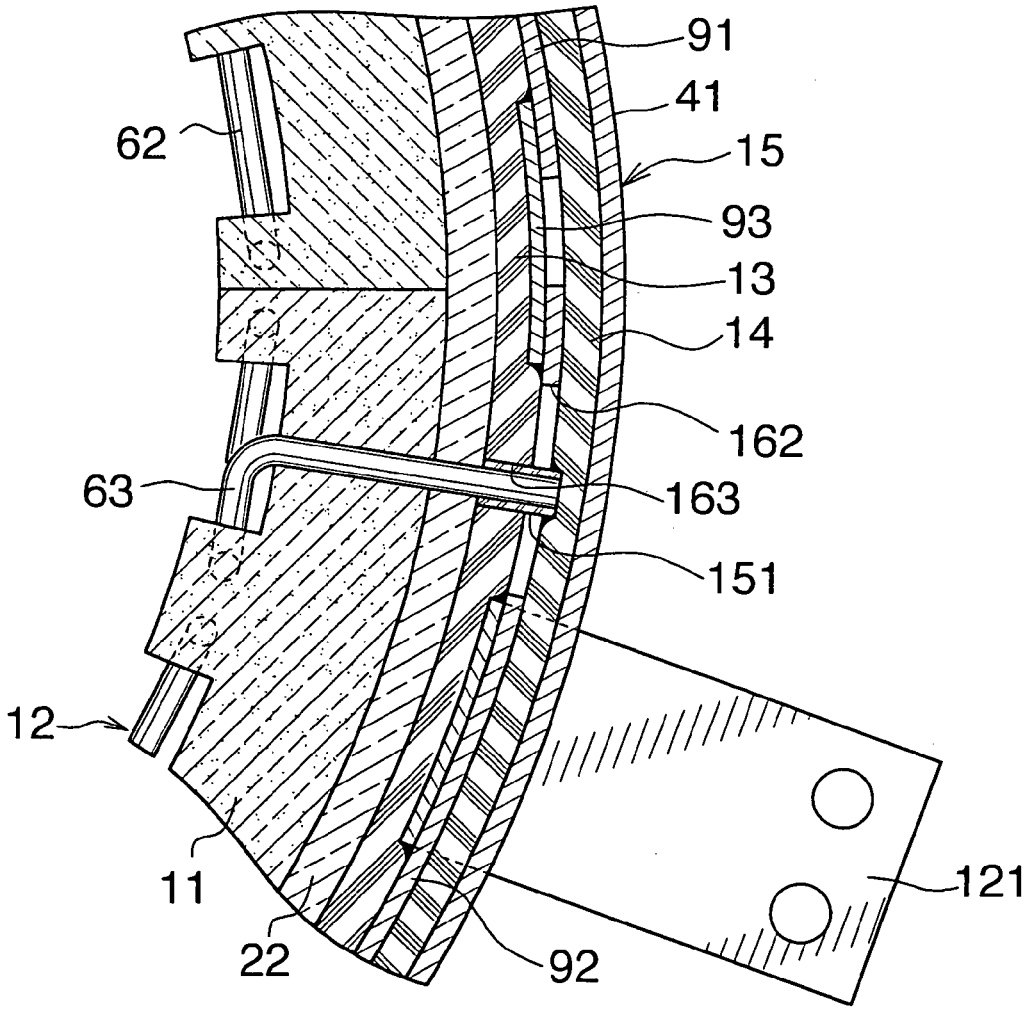
FIG. 6 is an enlarged transverse cross-sectional view which shows a connection condition of a part other than the one shown in FIG. 6.

FIG. 6 shows where a connection is made with the first lower connecting member (92) at left end of the third resistance heat emitting portion (63) of the group of resistance heat emitting portions for left zone (51L). Over an end of the third resistance heat emitting portion (63) is fitted a cylindrical sleeve (151) also. An oval hole (162) is formed in the connecting member (92). A round hole (163) is opened in the inner thermal insulating material (13) in agreement with this oval hole (162). The sleeve (92) pierces through an oval hole (162) and a round hole (163), and is connected to the connecting member (92) by welding. Additionally, FIG. 6 shows the way how the first terminal (121) is welded to the connecting member (92). Although not explained, an embodiment of the connection of other resistance heat emitting portions (64) (71)–(74) (81)–(84) with connecting members (91) (94) (95) (104) (105) (111) (112) (114) (115), and an embodiment of the connection of the connecting members (94) (101) (104) (111) (115) with terminals (122) (123) (124) are similar to the above.

Figure 8:
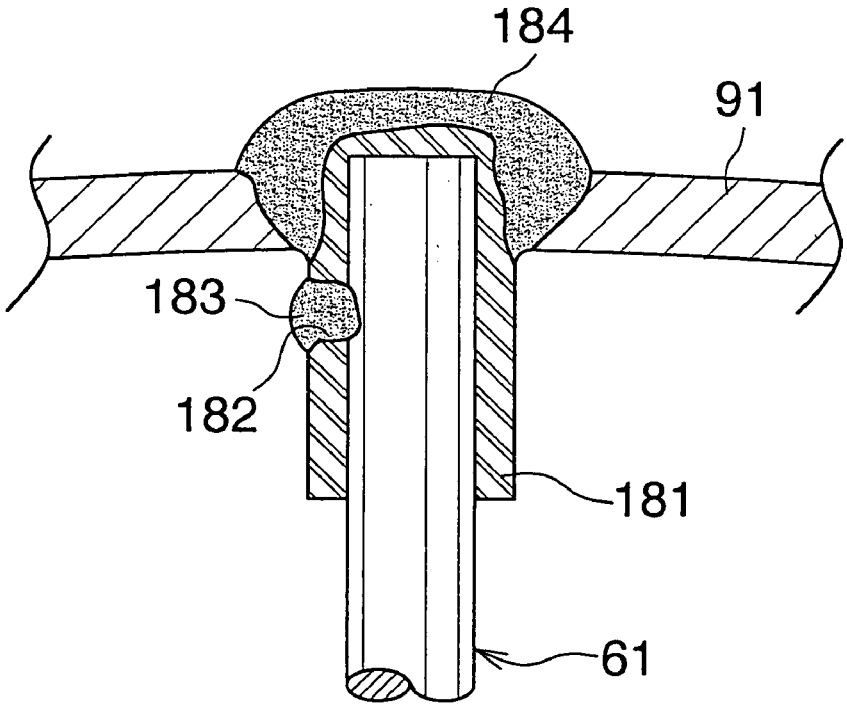
FIG. 8 is an enlarged cross-sectional view which shows a modified example of a part shown in FIG. 8.

FIG. 8 shows an example using a cap (181) instead of a cylindrical sleeve (131) shown in FIG. 7. A welding aperture (182) is opened to the circumferential wall of the cap (181). The welding aperture (182) is filled with a weldment (183), and top face of the cap (181) and its periphery are covered with another weldment (184).

Moreover, the first and second sleeves (131) (132) pierce through the inner thermal insulating material (13) and are made to protrude to its outside, where they are welded to the first upper connecting member (91). The first upper connecting member (91) is put between the inner thermal insulating material (13) and the outer thermal insulating material (14). Referring to FIG. 6, the sleeve (151), to which is inlayed the third resistance heat emitting portion (63), also pierces through the inner thermal insulating material (13) and is made to protrude to its outside, where it is welded to the first lower connecting member (92). Additionally, the first lower connecting member (92) is put between the inner thermal insulating material (13) and the outer thermal insulating material (14). Although not illustrated, other connecting members (94) (101) (104) (111) (115) are, likewise, put between the inner thermal insulating material (13) and the outer thermal insulating material (14).

Again, referring to FIG. 1, one can understand that the first terminal (121) is put through the slits (32*d*) (41*d*) on one side of the outer thermal insulating material (14) and the shell (15), while the left middle terminal (122) is put through slits (32*c*) (41*c*) on the other side.

All connecting members (91) (92) (94) (95) (104) (105) (111) (112) (114) (115), joint bars (93) (96) (103) (106) (113) (116), terminals (121) (122) (123) (124), sleeves (131) (132) (151), and a cap (181) consist of a same material as the heating element (12), namely metal of iron-chromium-aluminum system. By this configuration, one can overcome the troublesome sigma brittleness which is peculiar to this material, namely a property of getting brittle once it is heated to a high temperature.

As is apparent from the above-mentioned description, the present invention is neither limited to a heater of cylindrical shape, nor to semi-conductor heat treating furnace. For example, it can also be applied to flat plate type heater, and therefore find many applications in engineering fields.

Moreover, the present invention is not limited to what is disclosed in the above description, and various kinds of modifications are possible without departing from the scope of the present invention.

INDUSTRIAL APPLICABILITY

The electric heater of the present invention is particularly suitable for use as an electric heater for heat treating furnaces to perform, for example, heat treating equipments for oxidation, diffusion, and/or CVD of a semiconductor wafer.

What is claimed is:

1. An electric heater for a heat treating furnace comprising: a heating element which is made using a metal wire and installed at an inside surface of a main thermal insulation body;

an inner thermal insulating material layer and an outer thermal insulating material layer jacketing outside the main thermal insulation body; and the heating element comprising a plurality of resistance heat emitting portions which are disposed in parallel in the circumferential direction of the main thermal insulation body, wherein:

a pair of connecting members which are flat in thickness direction of the main thermal insulation body and extend along the circumferential direction of the main thermal insulation body are positioned between a inner thermal insulating material layer and the outer thermal insulating material layer respectively at a distance corresponding to a span between the heat emitting portions; and ends of each of the resistance heat emitting portions pierce through the main thermal insulation body and the inner thermal insulating material layer, and are connected to a connecting member of corresponding side, respectively.

2. The electric heater for a heat treating furnace according to claim 1, wherein the inner insulating material and the outer insulating material layers each comprise a pouch made of a heat-resistant cloth which encloses a great number of hollow microspheres of microporous thermal insulating material.

3. The electric heater for a heat treating furnace according to claim 1, wherein:

a sleeve is fitted on respective ends of respective resistance heat emitting portions, and fixed by at least either of calking and welding;

a number of open holes corresponding to the number of resistance heat emitting portions are opened in respective said connecting members; and the sleeve is put through an open hole at corresponding end, and the sleeve and fringe of the open hole are welded.

4. The electric heater for a heat treating furnace according to claim 1, wherein:

a cap is fitted on respective ends of respective resistance heat emitting portions, and fixed by at least either of calking and welding;

a number of open holes corresponding to the number of resistance heat emitting portions are opened in respective said connecting members;

the cap is put through an open hole at corresponding end, and the cap and fringe of the open hole are welded; and the resistance heat emitting portions, the connecting members, and the caps are formed out of a same kind of material.

5. The electric heater for a heat treating furnace according to claim 1, wherein:

a plurality of parallel grooves not less than the number of the resistance heat emitting portions are formed on the inside surface of the main thermal insulation body;

each of the resistance heat emitting portions is formed to sinuous shape with an amplitude bigger than width of the groove, supported unitedly by the main thermal insulation body with both end portions of the amplitude plunging beyond the sidewalls of the corresponding groove into the main thermal insulation body, and extending over to at least one neighboring groove.

* * * * *